United States Patent [19]

Lutes et al.

[11] 4,033,505

[45] July 5, 1977

[54] CYCLONIC, MULTIPLE VORTEX TYPE FUEL BURNER WITH AIR/FUEL RATIO CONTROL SYSTEM

[75] Inventors: Kenneth Vaughn Lutes, Escondido; Leland Golde Desmon, San Diego; Edward Dana Dodge, Poway, all of Calif.

[73] Assignee: Energex Limited, Portland, Oreg.

[22] Filed: Nov. 17, 1975

[21] Appl. No.: 632,205

[52] U.S. Cl. ..... 236/15 BD; 110/28 C

[51] Int. Cl.[2] ..... F23N 1/00

[58] Field of Search ..... 236/15 BD, 15 BF, 15 E; 110/28; 73/213

[56] References Cited

UNITED STATES PATENTS

| | | | |
|---|---|---|---|
| 1,677,691 | 7/1928 | Smith | 110/28 |
| 3,441,045 | 4/1969 | Malone | 98/1.5 |
| 3,607,117 | 9/1971 | Shaw et al. | 236/15 BD |
| 3,733,901 | 5/1973 | Halmi | 73/213 |

*Primary Examiner*—William Wayner
*Assistant Examiner*—R. J. Charvat
*Attorney, Agent, or Firm*—Chernoff & Vilhauer

[57] ABSTRACT

A cyclonic, multiple vortex type fuel burner having a combustion chamber with a closed curved end, with the main fuel and auxiliary fuel and air being tangentially injected into the chamber adjacent to the curved end creating a circular oriented combustion of the fuel, with the air being injected at varying quantities along the length of the combustion chamber, all to provide a controlled temperature in the burner chamber that burns all the combustible materials in the fuel and turns the non-combustible materials into dry slag or wet slag without burning the refractory materials forming the combustion chamber. The burner feeds a volume of air and fuel through fixed openings into the combustion chamber to provide a preset fuel/air ratio distribution along the length of the combustion chamber. This fuel-/air ratio is subject to change with changes in the amount or density of fuel fed to the burner. To maintain the controlled temperature under the changing fuel conditions, the fuel is carried by a positive displacement air system through which a control system determines the weight of the fuel being carried, and sets the volume of air to correspond thereto to provide the desired fuel/air ratio.

10 Claims, 13 Drawing Figures

CYCLONIC, MULTIPLE VORTEX TYPE FUEL BURNER WITH AIR/FUEL RATIO CONTROL SYSTEM

BACKGROUND OF THE INVENTION

A cyclonic type fuel burner is one in which the combustion materials and air move in a whirling movement during combustion. A particular example of an advanced type of cyclonic fuel burner is that illustrated in the U.S. Pat. to Lutes et al, No. 3,777,678. That patent discloses injecting the combustible materials and air tangentially into a horizontally disposed, circular combustion chamber to impart a whirling movement to the materials and their combustion. An auxiliary burner initiates the combustion, which is then maintained with the pressure, velocity and volume of air being changed along the length of the combustion chamber. This provides optimum flame length and burning of the materials, under relatively static conditions.

Systems utilizing such cyclonic type burners as illustrated in the Lutes et al patent, normally employ a control means for controlling the amount of fuel fed into the combustion chamber. The fuel feed is set by that required to provide the desired temperature of the combustion gases and other air mixed therewith at a point downstream from the burner. While this control system with this type of burner achieves very improved results in burning many types of fuel materials, it is desirable to achieve a more optimum control of the burn process and of the slag resulting from the burning and of the downstream temperatures, than has been possible with the known cyclonic type burners.

SUMMARY OF THE INVENTION

In an exemplary embodiment of the invention, an improved cyclonic type fuel burner is used to burn small particle type fuels. Such materials are carried by a positive displacement air system from a fuel supply to the burner. The combustion materials are then injected tangentially into a cylindrical combustion chamber. The combustion chamber has a closed front end and a rear end with a choke opening therein for passing the combustible gases therethrough. The ends are interconnected by a cylindrical wall, and all of the walls comprise refractory material. The front end has a concave inner surface that aids in combustion in the manner to be described hereinafter.

There are two openings in the side of the combustion chamber adjacent to the closed end for feeding the fuel into the chamber. The openings comprise a first opening for the fuel and a second opening for the auxiliary burner. The ignited auxiliary burner creates auxiliary combustion gases that heats the inner surface of the combustion chamber and ignites the combustible materials that are injected into the chamber through the first opening. Air is injected tangentially into the combustion chamber in a manner that both cools the inner surface of the combustion chamber and also creates a double vortex combustion that is centered by the curved end wall. Means are provided for injecting different volumes of air through the openings along the length of the combustion chamber into longitudinally arranged, spaced segments of the combustion chamber, so that there is an excess of air present in the chamber with the air excess increasing from the front or closed end of the chamber to the hot gases discharge end of the chamber.

Many different types of fuels are burned in the cyclonic type burner. These fuels comprise combustible materials of different weights and includes components that are not combustible. The non-combustible components can create polution problems outside the burner, either in the ambient air or in the subsequent processes, such as in wood drying kilns and the like. Thus it is advantageous to be able to minimize the pollutants in the gas by removing them from the burner in the form of a dry slag or wet slag.

However a problem exists in doing this, in that the temperature required to reduce the non-combustibles to the desired wet slag condition closely approaches the temperatures that can cause serious damage to the refractory materials in the combustion chamber. Thus to achieve the slag elimination and the optimum combustion of the fuels, while using many different types of fuels often interchangably, and yet not burn and escessively damage the refractory of the combustion chamber, requires a very close control of the fuel/air ratio during changes in fuel density and the demand for fuel. In this invention, an optimum cyclonic, multiple vortex type fuel burner is employed with an optimum fuel and air delivery system to the burner, to achieve and maintain the desired combustion temperature within the burner to achieve slag elimination while not burning or excessively damaging the refractory, over a wide range of changes in fuel materials supplied to the burner.

In the embodiment, the closed end wall is curved to aid in centering and holding centered, the vortex of combustion. Changes in the air pressure and air volumes supplied to the combustion chamber and with changes in the amount and type of fuel, the vortex of combustion will move within the combustion chamber. This is undesirable for many reasons and is substantially eliminated by the curved end wall. Also in the embodiment, the auxiliary burner is positioned so its flame is adjacent the primary fuel opening, thus providing an improved combustion of the primary fuel materials initially injected into the combustion chamber. This mounting of the auxiliary burner also directs greater heat to the inner walls of the combustion chamber that aids in achieving the desired kindling temperature of the later injected primary fuel. The air is supplied to the burner through multiple chambers, with the total volume of air being controlled by a single damper. Thus the air conducted to each of the separate compartments is set by the size of the openings into the combustion chamber, and by fine setting valves in the air conduits to each of the separate compartments.

In prior systems, the amount of fuel supplied to the burner is set by the desired downstream temperature of the discharged gases. Such a control system increases or decreases the volume of fuel fed to the burner, thus increasing or decreasing the BTU output. Density changes change the fuel/air mixture, which can be a very serious operational limitation when the burner is being operated at a critical temperature just above that required to provide dry or wet slag conditions. In this system, the positive displacement air source carries the fuel from a fuel supply to the burn chamber. This fuel and positive displacement air passes through a mixing tee that measures any change in the amount or weight of the fuel being supplied to the burner, which information is transformed into an electrical or pneumatic signal that is compared with an electrical or pneumatic signal reflective of the weight of air supplied to the burner. This comparison signal is used to control the damper in the air supply to provide the optimum fuel-/air ratio. A delay is incorporated into the control system to adjust the fast response time of the air damper with the slower change in the fuel delivery to the burner.

Accordingly, optimum high temperatures can be mainained in the burner even though changes in fuel supply, types of fuel, density of the fuel, and the like are occurring in the system.

It is therefore an object of the invention to provide a new and improved cyclonic, multiple vortex type fuel burner.

It is another object of this invention to provide a new and improved method and apparatus for providing optimum fuel/air ratio control of cyclonic type burners.

It is another object of this invention to provide a new and improved cyclonic, multiple vortex type fuel burner with an auxiliary burner inlet that provides improved initial wall heating and also provides initial combustion vortex location at the center of the combustion chamber.

It is another object of this invention to provide a new and improved cyclonic, multiple vortex type burner that provides a uniform and set control of different air distributions along the length of the combustion chamber, which air distributions are maintained with changes in the amount of air injected into the combustion chamber and with changes in fuel weight and volumes.

It is another object of this invention to provide a new and improved cyclonic, multiple vortex burner that reduces the non-burnables to a dry or wet slag condition, and removes those non-burnables from the burn chamber and from the gases leaving the burn chamber.

It is another object of this invention to provide a new and improved fuel/air ratio control of the air and fuel supplied to the burn chamber, that in coordination with the cyclonic, multiple vortex type fuel burner, is capable of holding the temperature within the burn chamber to that required to provide wet slag or dry slag non-combustibles without burning the refractory.

It is another object of this invention to provide a new and improved fuel/air ratio control system wherein the ratio of delivered fuel and combustion air is controlled automatically.

Other objects and many advantages of this invention will become more apparent upon a reading of the following detailed description and an examination of the drawings, in which like reference numerals designate like parts throughout and in which.

Figure 1:
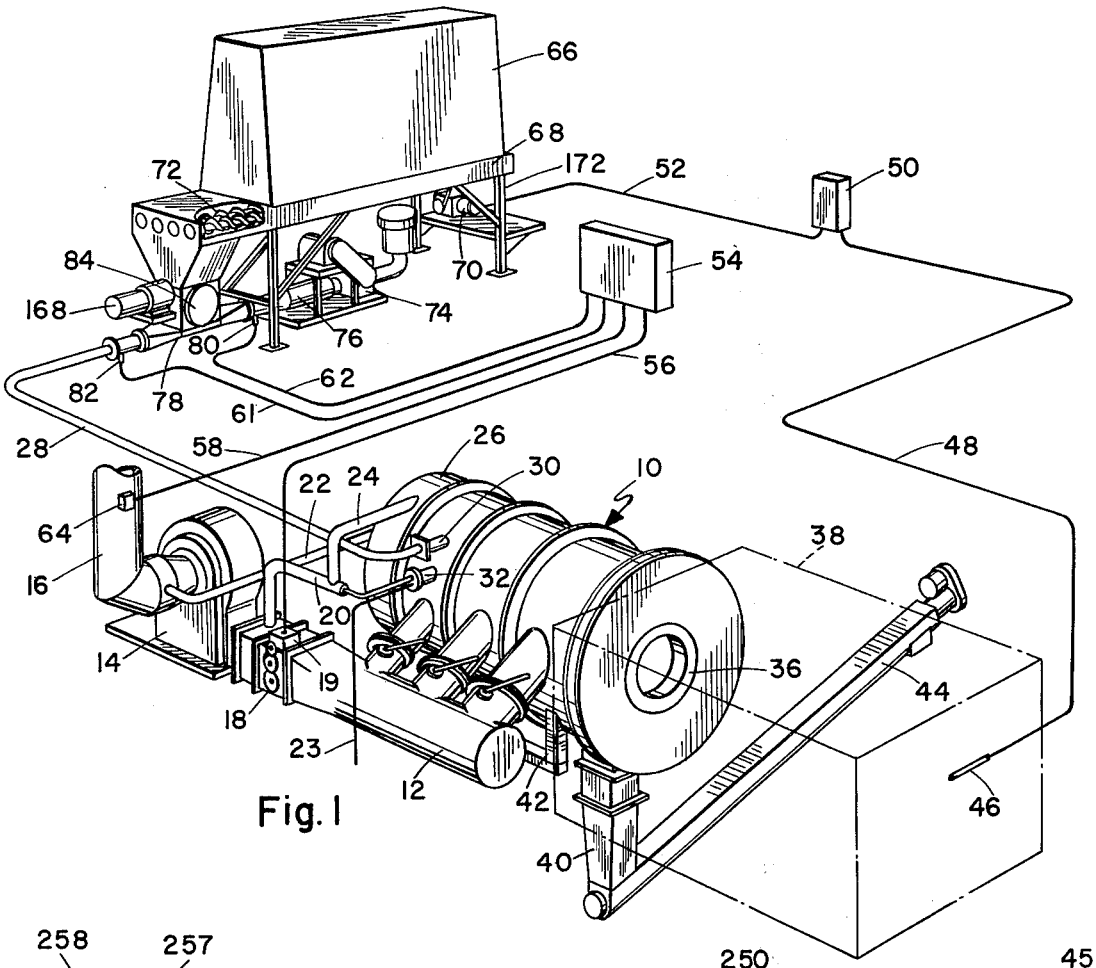
FIG. 1 illustrates the complete burner and fuel supply system.

Referring now to FIG. 1 of the drawings, a burner 10 that burns solid fuel in particle form is mounted on a support cradle with legs 42. Both the fuel and combustion air enter the chamber 10 tangentially, promoting the cyclonic flow pattern that will be described in more detail hereinafter. The burner has an outer housing with a plurality of sections. The heat from the burner exits out the opening 124.

The fuel generally comprises particles type, combustible materials such as sawdust, hogfuel and the like that may have different densities. The fuel is moved into a metering bin 66, and then is moved by screw type conveyors 72 in the lower portion 68 of the bin 66 to the hopper of the rotary air lock 84 that is driven by a motor 168. The fuel then passes through the rotary air lock 84 into a mixing tee 78, and from there by way of fuel line 28 to the fuel connector 30, where the fuel is fed into the combustion chamber tangentially. A motor 70 drives the conveyor screws 72 in the live bottom 68 of the fuel metering bin 66. A positive displacement blower or air pump, such as a Roots blower, supplies air under pressure in a positive displacement system which air through line 76 is mixed with the fuel in the mixing tee 78. The rotary air lock restricts air passing into the metering bin 66.

Air is supplied to the burner 10 by a blower 14, which blower draws air through pipe 16 and discharges the air through a manifold 12. The air flow is controlled by a combustion air flow control device or damper 18. The burner 10 also has an auxiliary start-up burner 32 for pre-heating the combustion chamber and for initially igniting the fuels supplied through line 28 and the connector 30. The start-up burner 32 receives fuel from a metered source not shown, through line 23 and receives air through line 20. Lines 32 and 24 provide cooling air to the end 26 of the burner 10. The burner 10 also has a slag removal system 40 that moves the slag through a conveyor 44 to a point of transportation away from the system.

The burner has a fuel/air ratio control system. Its purpose is to control combustion temperatures so that the burner 10 may be operated in the most efficient manner and prevent undesirable effects such as overheating.

The usual case of overheating is operation of the burner at a fuel/air ratio too near the stoichiometric mixture. Further, unless the combustion air flow rate is continuously controlled to remain in the desired ratio to the weight flow of fuel, this ratio will vary continuously as fuel density, burner discharge pressure, air temperature and many other independent variables change. In addition to causing the burner to overheat on lean fuel/air mixtures, a lack of fuel/air ratio control can result in mixtures so rich that the fuel particles leave the burner in a partly unburned condition.

A sensor 46 in the process equipment (FIG. 1) to which the burner 10 is attached sends a signal to a standard controller 50 where it is compared with a set point. Although the sensor 46 is often a temperature sensitive device, it can be a pressure sensor of any of a number of other transducers. If a difference exists between the sensor signal and the controller setpoint, the controller 50 causes the speed of the metering bin screws 72 and the fuel delivery to increase or decrease as required. A fuel/air ratio control 54 monitors both the fuel weight flow and the combustion air and causes the air flow to remain in an essentially constant proportion to the fuel weight.

Figure 2:
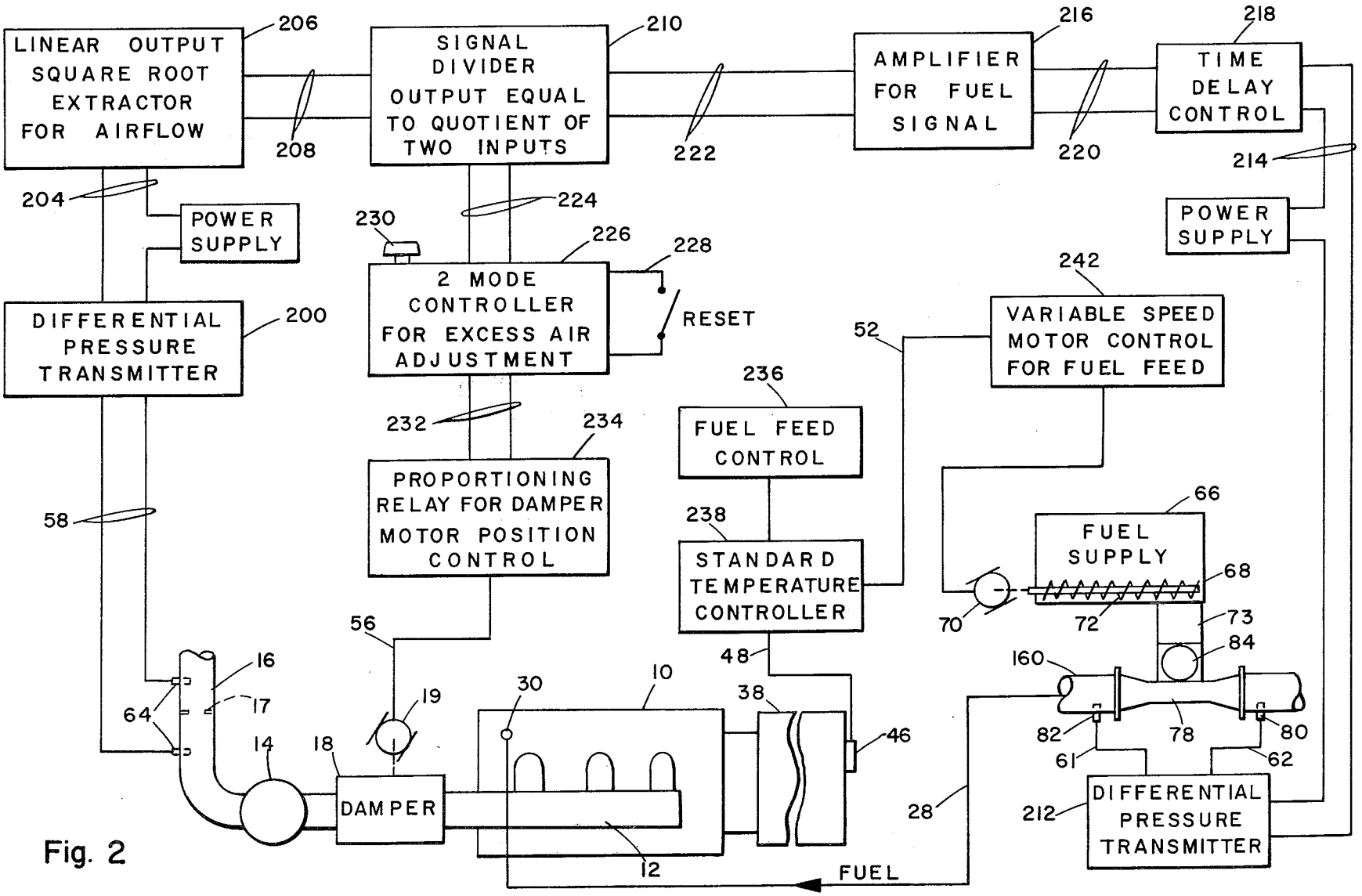
FIG. 2 is an illustrative diagram of the fuel/air ratio control system.
Figure 3:
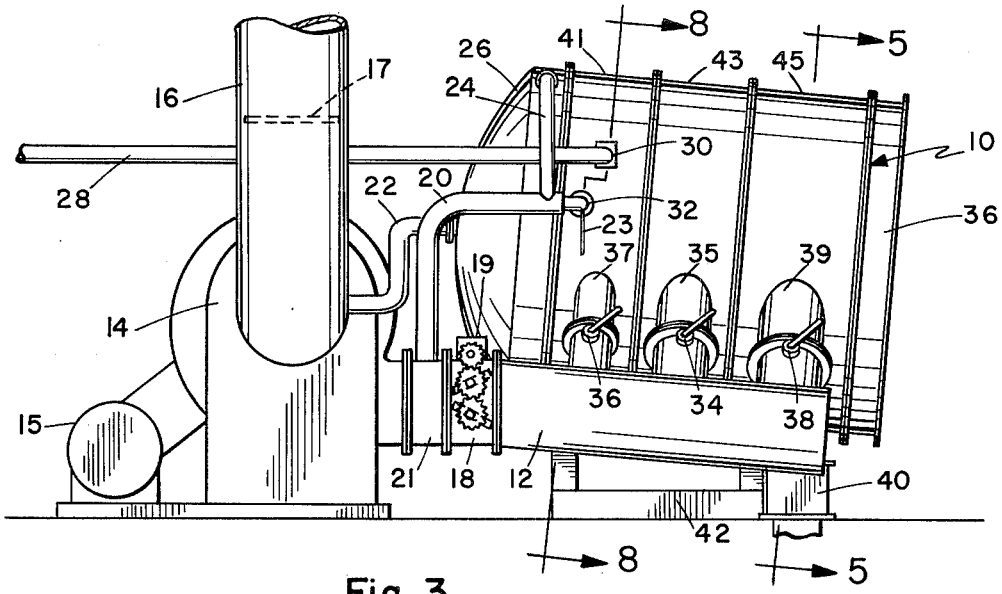
FIG. 3 is a side elevation view of the burner assembly.
Figure 4:
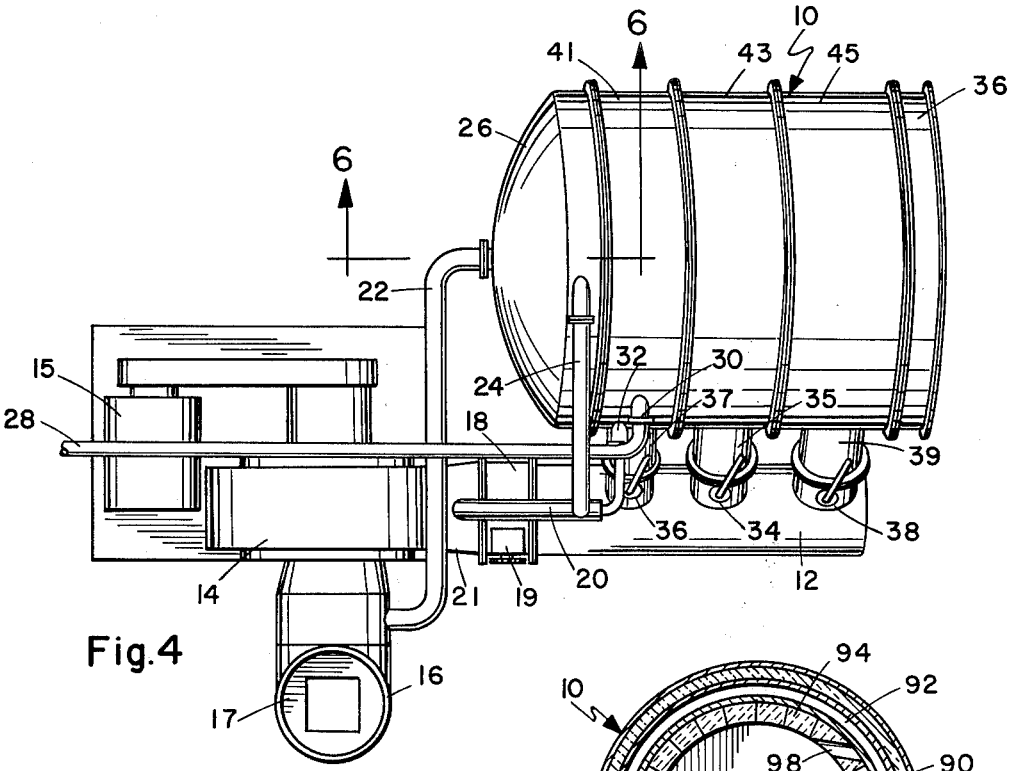
FIG. 4 is a top plane view of the burner assembly.

Referring to FIG. 2, the differential pressure transmitter 212 senses the pressure difference across the mixing tee 78, resulting from accelerating the fuel dropping into the tee 78 from the fuel supply bin 66 through the rotary air lock 84. This pressure differential is proportional to the mass of fuel and is essentially independent of its density.

The differential pressure transmitter 212 sends the fuel weight flow rate signal through an adjustable time delay control 218 to the signal divider 210. The time delay control 218 prevents premature actuation of the combustion air damper. Without it, premature actuation would occur because the mixing tee 78 is remote from the burner and the fuel requires time to traverse the distance. The signal to the damper motor 19 is almost instantaneous, however, and without the delay, the fuel/air ratio control would set the air flow to the burner for a fuel rate which has not yet reached the inlet to the burner. Distances of 500 feet and more between the fuel bin and the burner are not uncommon and an associated signal delay of 6 to 8 seconds may be required.

The airflow rate signal passes through a linear output, square root extractor 206 in going from the differential pressure transmitter 200 to the signal divider 210. The square root extractor transforms the normal head meter characteristic from a square curve to a straight line as required by the signal divider 210. Any of a wide range of head meters such as an orifice plate or a pilot tube may be used to produce the air flow rate signal.

The signal divider 210 sends a signal to the two mode controller 226 that is proportional to the ratio of the processed fuel and air signals. The desired operating excess combustion air rate is set on dial 230. Upon comparing the incoming fuel/air ratio measurement signal with the set point, the controller 226 sends a control signal to the air damper motor 19 to reduce or increase the airflow as required.

In this fashion, the fuel/air ratio controller 54 constantly monitors both the fuel weight flow and combustion air flow and controls the air flow to maintain an essentially constant fuel/air ratio. Given a constant fuel/air ratio, combustion gas temperatures both inside and outside the burner tend to remain independent of heat release rate thereby allowing optimum conditions over the range of operation.

Figure 8:
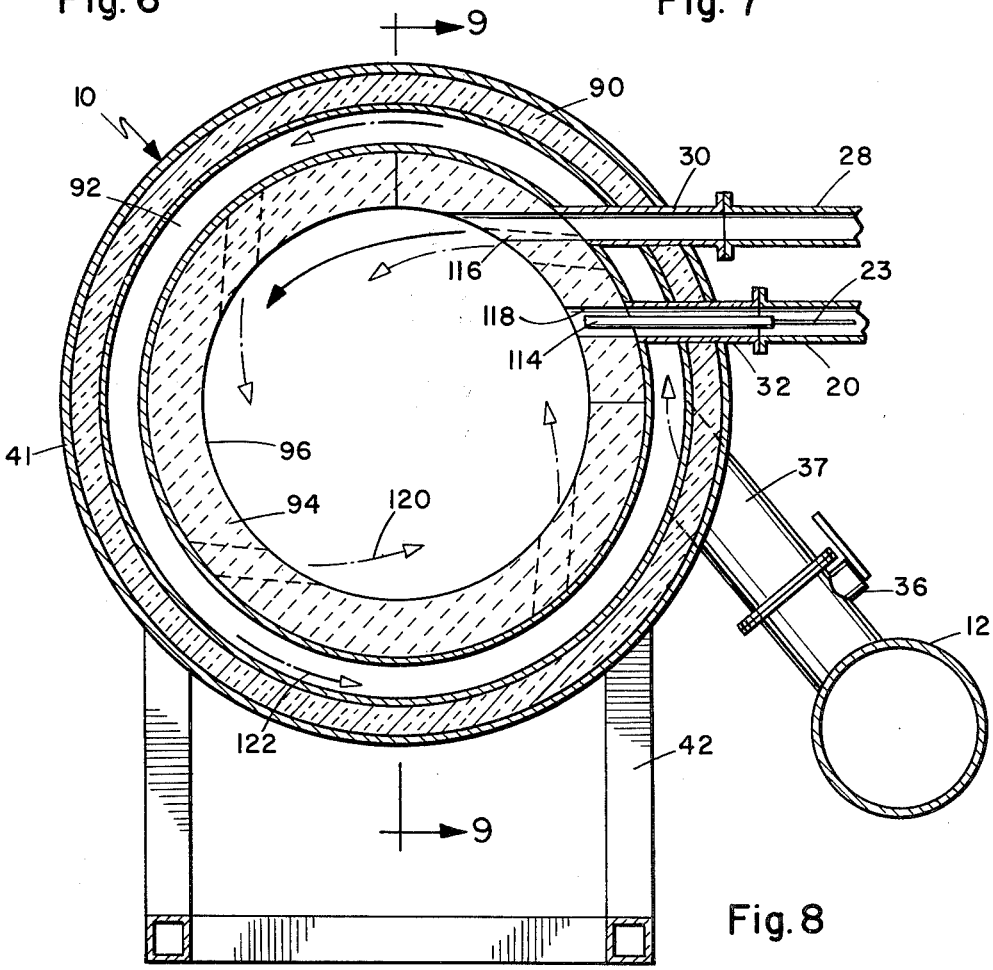
FIG. 8 is an enlarged sectional view taken on line 8—8 of FIG. 3.
Figure 9:
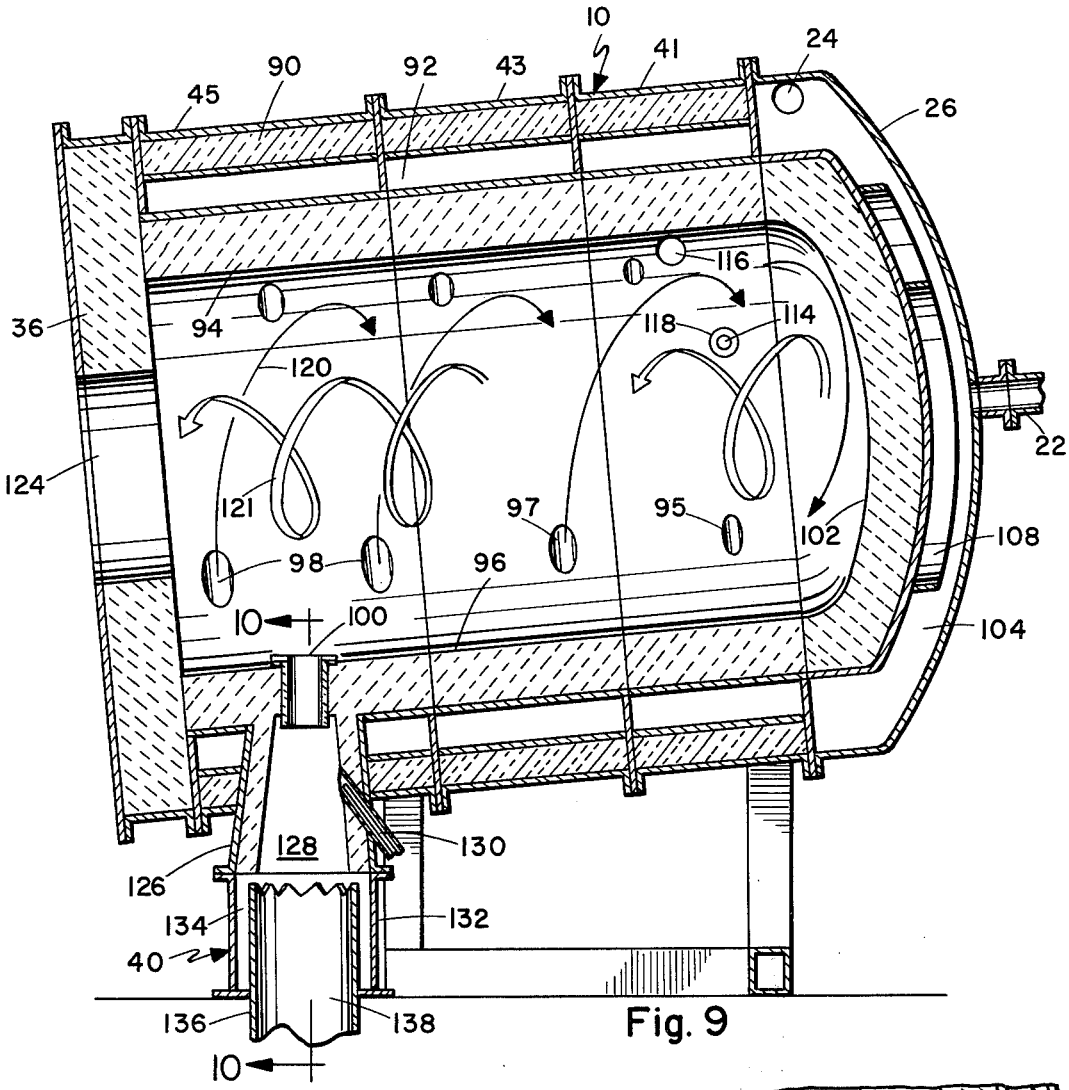
FIG. 9 is a sectional view taken on line 9—9 of FIG. 8.
Figure 10:
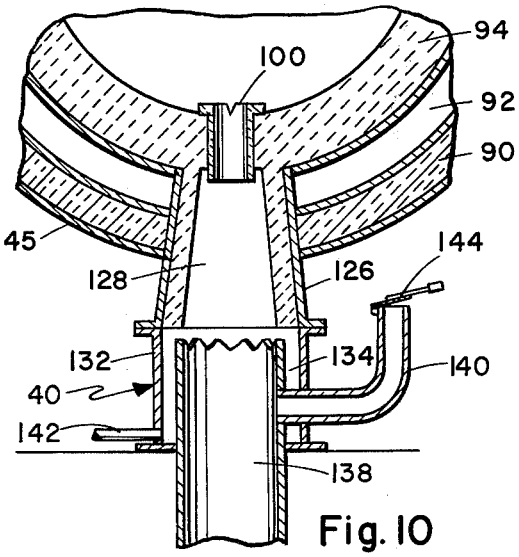
FIG. 10 is a sectional view taken on line 10—10 of FIG. 9.

Referring now to the burner 10, see FIGS. 3 through 11, an outer shell may be made of steel of other suitable materials that, for purposes of this embodiment, has an end-section 26 and three or more separate middle sections 41, 43 and 45 and a discharge section 36. Referring to FIG. 9, the outer wall has a liner of insulation 90 such as refractory material or the like that encloses an air plenum 92 that is split into three or more compartments, as defined by sections 41, 43 and 45. The inner combustion chamber comprises an inner liner of abrasion resistant, high temperature refractory 94. The hot gas discharge section 36 comprises a refractory orifice plate in a steel sleeve having a restricted opening or choke 124. The choke 124 and orifice plate 36 function to increase the combustion chamber pressure, intensifying the cyclone and promoting complete combustion within the burner. The refractory has an inner surface 96 with openings 98 communicating thereto from the air plenums 92.

Referring to FIG. 8, combustion air is supplied through manifold 12 and through the three or more air supply conduits, an example being conduit 37, to the air plenum chambers 92 where the air passes through air tuyeres that are angled to supply the air tangentially as represented by arrow 120, into the combustion chamber 96. Thus the air flows through each of the conduits 35, 37 and 39 to the respective sections of the air plenum 92 and through the tuyeres 95, 97 and 98 into the combustion chamber 96 tangentially.

In operation of the burner, it is necessary to provide a different amount of air along the length of the burner from the front end 26 to the discharge end 36. The amount of air supplied is generally established when the burner is built, but in this burner, air is injected through openings 95, 97 and 98 so that different volumes of air are supplied along the length of the chamber 92. Thus an excess of air is present in the chamber 92 with an air excess increasing from the front wall 102 to the back wall 36. To accomplish this, openings 95, 97 and 98 vary in size relative to the smaller amount of air being injected into the burner from the front end to the discharge end. Additionally, conduits 37, 35 and 39 and butterfly valves 36, 34 and 38 are used to set the amount of air for each of the sections. However, it is to be understood that the total amount of air supplied to the burner is controlled by the air flow control device 18. Although the air flow control device 18 shown is a blade-vane damper, any flow control with a quasi linear response would be satisfactory.

The main solid fuel is fed to the burner as previously described through connector 30. This connector 30 passes through the plenum chamber 92 and to the fuel nozzle 116, which injects the fuel tangentially into the combustion chamber 96. Thus the air and fuel circulate cyclonically in the combustion chamber 96. The air leaving the tuyeres as indicated by arrow 120 functions to cool the refractory surface of the combustion chamber 96 and to achieve maximum combustion in the cyclonic burner.

To initiate operation, the auxiliary burner burns normal fossil fuel and receives air through line 20 to support combustion. This burning heats and raises the temperature of the inner surface of the refractory, and also being positioned upstream of the circulating air 120 and the fuel injected through opening 116, ignites the fuel. Referring to FIG. 9, the fuel opening 116 and the auxiliary or start-up burner opening 118 are positioned in section 41 and thus displaced from the concave end surface 102. When the burner is fired, then the air passes into the burner in the direction of arrows 120 in a cyclonic circular movement toward the center of the combustion chamber 96. This vortex movement of the air then reverses in the burn process to a centered vortex correspondng to arrows 121 that is moving concentrically in the opposite direction, where the hot gas then passes out through the choke opening 124. The excess air distribution from the front wall to the back wall in the chamber aids in this burn process. This allows a double vortex burn process to form in the combustion chamber 96, that achieves maximum combustion of the combustible materials. Accordingly, only hot gases pass out through the opening 124 and only a very small or slight amount of non-combustible materials or impurities pass through with the hot gases. With the accumulation of non-burnable materials or ash within the combustion chamber 96, the ash or slag accumulates in the bottom of the burner where it is removed.

In the burn process, the desired temperatures must be maintained within the burner to assure that all combustible materials are burned within the combustion chamber 96. The non-combustibles then take the form of either a dry slag or a wet slag. With wet slag, the non-combustible materials are raised to their liquidifying temperature. For example, dry slag temperatures may be between 2100° and 2400° and wet slag temperatures may be between 2400° and 2800°. By temperature control within the burner by the control systems to be described in more detail hereinafter, the residue is converted within the combustion chamber 96 to either a melted slag or a dry slag. Where wet slag conditions occur, the slag flows down the bottom surface into a receiving conduit 100 of suitable refractory material, see FIGS. 9 and 10. The slag then drops through chamber 128 into the volume 138 of well 136, where it is removed by the slag removal conveyor 44. Water is supplied through line 142 to the well volume 138, that quenches the wet slag. A heater 130 functions to heat the compartment 128 in sleeve 126 to that temperature required to maintain the slag in the molten condition, so that the conduit 100 does not become clogged in operation.

Figure 11:
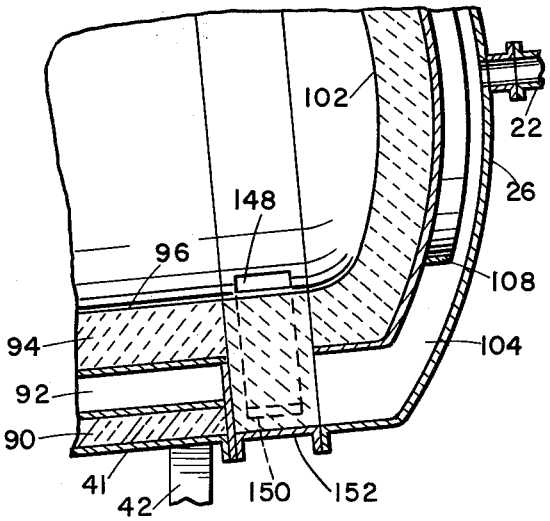
FIG. 11 is a sectional view, similar to a portion of FIG. 9 showing a dry ash drop-out.

During dry slag operations or where dry slag occurs, the slag is collected in removal unit 150, illustrated in FIG. 11. This unit is positioned through the refractory forming an opening 148 for collecting purposes, which slag is then removed through a suitable system through the lower end opening 150. The dry slag opening 148 may be positioned anywhere along the length of the combustion chamber 96. Also the burner may be positioned at an angle, see FIGS. 3 and 10, for wet slag operations and positioned horizontally for dry slag operations. The slag removal well 138 is provided with a vapor vent 140 having a weighted opening 144 that allows steam to leave the system, but maintains the compartments 128 and 138 at a pressure slightly below combustion chamber 96 pressure to inhibit the flow of combustion gas through opening 100. It should be understood that both dry slag and wet slag installations may be made and operated in the same burner 10.

As previously described, the combustion process in the combustion chamber 96 takes the form of a double vortex. This causes the gases in the center part of the burner to have a very high temperature that extends to the concave surface 102 of the end 26. This curved surface functions to increase the intensity of the double vortex burn process, and also centers the double vortex in the cylindrical shaped combustion chamber 96, even with changes in air input to the combustion chamber, or with changes in the weight of fuel or other occurrences. While the concave surface holds the vortex centered within the combustion chamber during changes in the combustion process, this centralizes the temperature onto the end surface 26. To reduce this high temperature effect on the refractory, air is supplied through line 24 to a cooling chamber 104 and out discharge line 22. A spiral wind vane 108 circulates the air within the chamber 104 over surface 112, thus assuring distribution of the air within the chamber 104. As shown in FIGS. 1 and 8, this cooling air is drawn from the air input to the burner 32 and is discharged by discharge line 22 for return to the air input conduit 16 of the blower 14.

The main combustion air system comprises a platform mounted industrial blower 14 having a motor and belt drive 15. This blower 14 supplies air to the air manifold 12 through the combustion air flow control 18. It will be noted that the air supplied to the auxiliary fuel device 32 is tapped off upstream of the flow control device 18. Thus any change in the flow of air to the auxiliary fuel device is not controlled by the combustion air flow control mechanism.

During the operation of the burner and after initial start-up, air continues to flow through openings 118 and 116 with the fuel. This air flow prevents heated gases in the combustion chamber from flowing back into the pipes, thus creating heat problems relative to the fuel therein. However, it may be recognized that this necessary air flow has a constant magnitude and is not subject to change when it is desired to change the air into the combustion chamber 96 by means of the air control device 18, that is controlled by motor 19.

It is desired to maintain the temperature relationship within the combustion chamber 96 at the temperature required to provide dry or wet slag, and to still maintain the amount of hot gases or BTU output at the desired rate. The amount of BTU output is controlled by controlling the fuel supplied to the burner. However, changes in the input fuel can provide a change in the fuel/air ratio within the combustion chamber, which changes the combustion temperatures within the chamber 96, to such an extent that it can vary from the desired slag temperatures and can reach temperatures that can damage the refractory within the combustion chamber.

Figure 12:
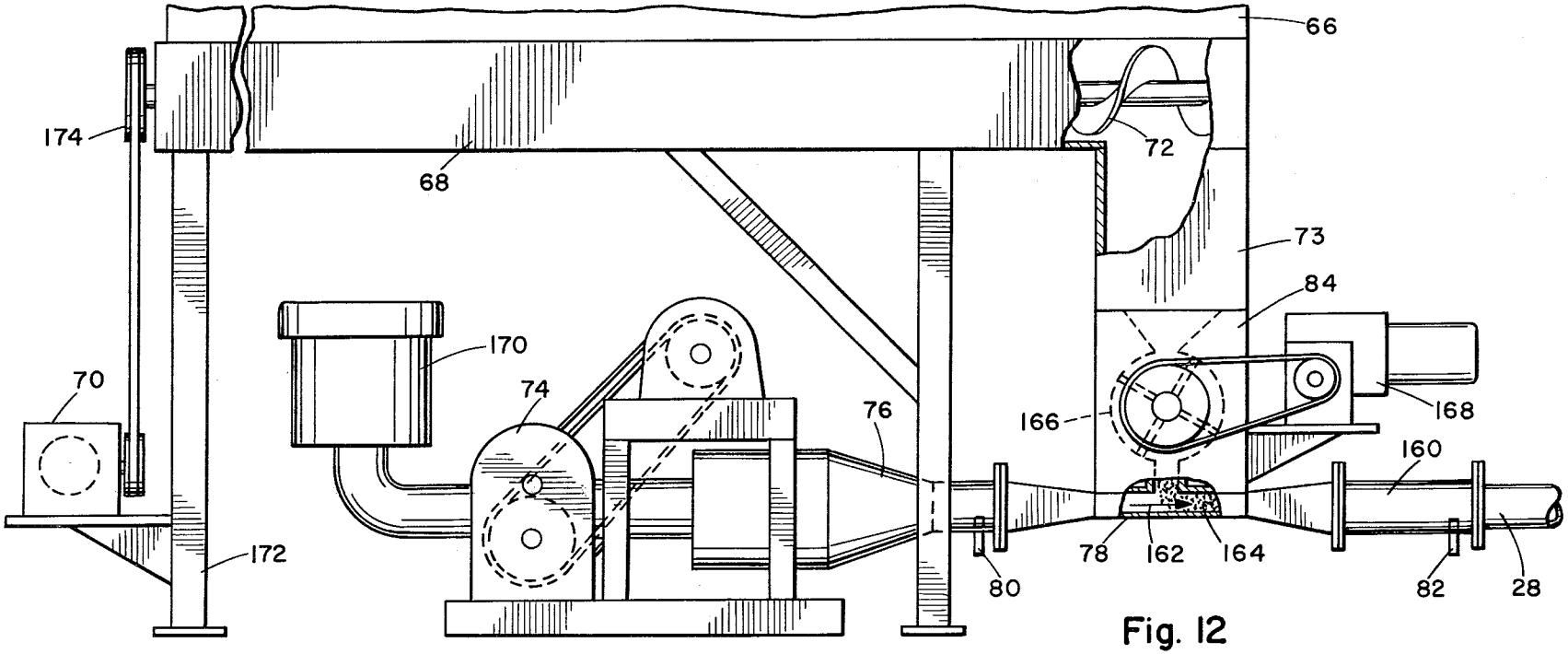
FIG. 12 is a side elevational view of the fuel supply and feed system.

As previously explained and with reference to FIG. 12, a positive displacement or Roots type blower air supply system 74 takes air through a breather 170, and feeds this air through line 76 to the mixing tee 78. The fuel 164 passes through the mechanical rotary air lock 166 and into the mixing tee 78 where the carrying air 162 is moving. Air driven by the positive displacement blower picks up the combustible material and carries it through line 160 and line 28 to the burner 10. In the positive displacement air conveyor system, the rate of fuel being moved, by weight, is determined by measuring the pressure drop across the mixing fee 78. This pressure drop provides a linear relationship. Thus pressure detectors 80 and 82 provide output signals to a differential pressure transmitter 212, see FIG. 2, which differential is directly proportional to the amount of particle fuel 160 being carried in line 28. This differential pressure output signal is fed through lines 214 to the time delay control 218 and to the amplifier 216.

The amount of air passing into the burner 10, except that constant supply of air from the fuel delivery conduits, is proportional to the air moving through the blower 14. This air flow is measured by any of a variety of flow detectors, such as an orifice plate, in which pressure taps 64 feed signals through lines 58 to the differential pressure transmitter 200. It is known that through flow meters such as a flat plate orifice, the flow rate can be determined in the pipe by the pressure differential across the pressure taps. However, this provides a square relationship that is typical of all head measuring flow meters. The flow rate is, however, proportional to the square root of the differential pressure drop. The differential pressure transmitter 200 converts the pressure differential relationship into an electrical difference signal that is fed to a non-linear amplifier 206 in which the square root of the signal is extracted and a linear output is fed through line 208 to the signal divider 210. This non-linear amplifier 210 provides an output equal to the quotient of two inputs, fuel and air. This signal is fed through lines 123 to the two mode controller 226.

The signal divider 210, may, for example, provide an output as follows. When the input in lines 208 is A and the input in lines 222 is B, then the output of the amplifier 210 may be equal to 10 A/B. This output is then fed through lines 224 to the two mode controller 226 for excess air adjustment. This circuit is a known 2-mode controller with an adjustable, proportional band and reset action.

The controller 226 detects the output from amplifier 210, which amplifier output is a signal amount representative of the fuel/air ratio being supplied to the burner 10. As previously stated, the desired fuel/air ratio is preset through dial 230. Thus the input signal in lines 224 is compared with that preset ratio in controller 226, and the difference above or below the setting provides an operating signal through lines 232 to the proportioning relay for damper motor position control 234, that selectively operates the motor 19 by signals through lines 56 that sets the position of the damper 18. The controller 234 detects whether the signals in lines 232 are calling for more or less air to satisfy the fuel/air ratio preset into controller 226. It responds by increasing or decreasing the air until controller 226 is satisfied with the fuel/air ratio.

As the fuel feed to the burner 10 changes to satisfy the heat demand, an imbalance between the fuel/air ratio occurs. However, the differential pressure transmitter detects the change in weight of fuel supplied to the burner 10 and feeds this new signal through the circuit previously described for a comparison with the preset and desired fuel/air ratio. This increase in fuel is thus detected and causes the damper 18 to open or close, increasing or decreasing the air to the burner 10, thus maintaining the desired fuel/air ratio.

The time of travel of fuel through line 28 to the burner 10 is usually longer than that required to change the amount of air through damper 18. Since it is undesirable to have the air increased prematurely, the delay time of movement of an increase in fuel from the mixing tee 78 to the burner 10 is calculated, and this time delay is then set in the time delay control device 218, that provides a delay in the output of the amplifier in response to a signal from line 214 to lines 222. Thus changes in the fuel which require changes in the air are synchronized at the burner 10.

As previously mentioned, the fuel supply may comprise any of several different types of fuel, all of which may have different densities. Generally, the BTU output for a given amount of fuel is directly proportional to its weight. An increase in the weight of fuel will provide a proportional increase in the differential pressure across the measuring tee 78. This causes a proportional increase in the air supply to the burner 10. Since a change in density of fuel can occur with no change in the speed of the fuel feed screws 72 or the temperature controller 238, this would result in a weight change which could disrupt the combustion output of the burner 10, as an increase in the temperature of the output gases will result. However, this increase is detected by sensor 212 resulting in a change in the amount of air supplied until controller 226 is satisfied. Thus the system is returned to the correct fuel/air ratio. It can be understood, that if there is a decrease in the temperature of the burner 10, then in a wet slag operation the slag would harden and thus create problems. However the control system averts this, and in the same manner, prevents rapid increases in the critical temperatures in the combustion chamber.

Figure 13:
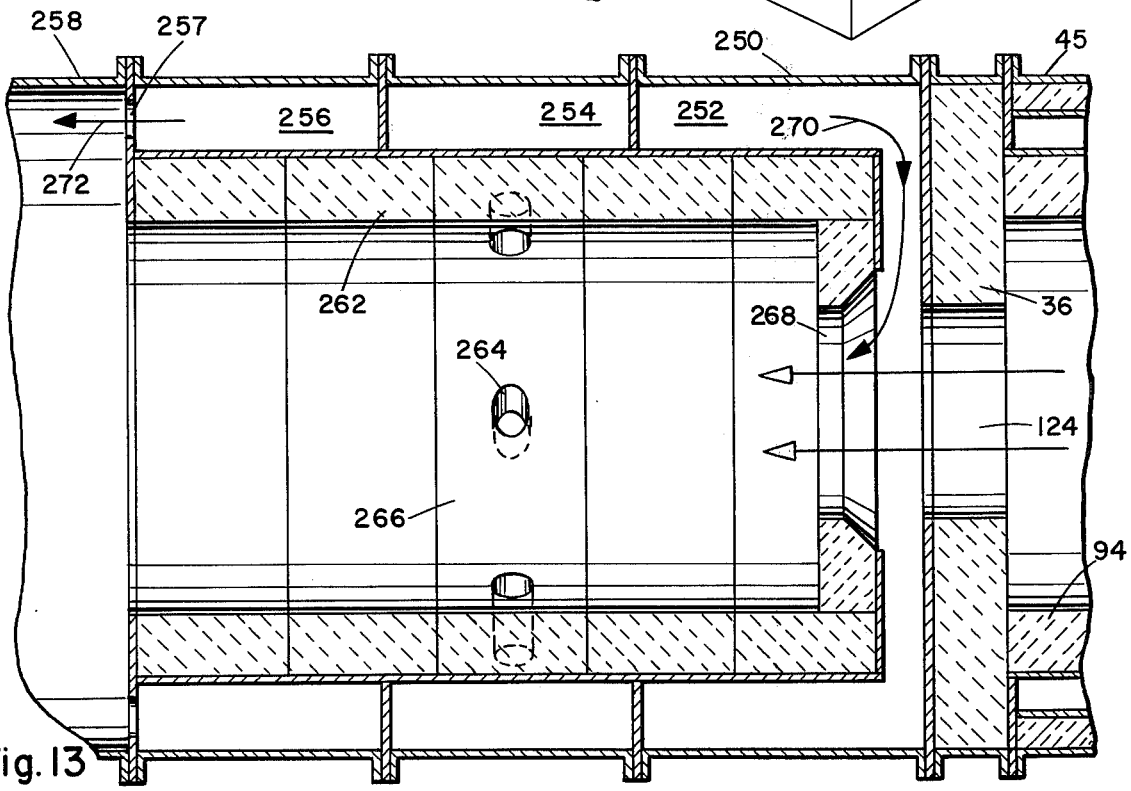
FIG. 13 is a sectional view similar to a portion of FIG. 9, with a cylindrically shaped blender unit attached to the burner.

In operating the burner 10 and thus providing heated gases to subsequent processes such as for drying lumber and the like, it is often necesssary that the temperature supplied to the process be lower than that effectively derived from the burner. Thus recycled gases or fresh air is introduced into the discharged gases from the burner 10 to lower the combustion gas temperature at the face of the heat consuming device. The blend box, see FIG. 13, is a steel jacketed cylinder 250 that is open at both ends and has an annular air plenum lined with abrasion resistant, high temperature refractory 262. The annular air plenum is, for example, as illustrated in FIG. 13, divided into three sections 252, 254 and 256. The air supplied to the plenum chamber sections is from a source not shown, that may be similar to the manifold 12 of FIG. 1.

In operation of the blend box, the box is attached directly to the end 36 of the burner 10. The hot gases thus pass through choke opening 124 and through opening 268. Air from chamber 252 follows the course of arrow 270 and thus blends with the hot gases passing through choke opening 124. This first chamber air input functions to chill the slag in the heated discharged air from the burner and removes the slag so it will not pass on with the hot gases damaging whatever materials are being heated in the subsequent processor. Air also passing through the tuyeres 264, mixes with the gas stream passing therethrough and further reduces the gas temperature. The air out of chamber 256 passes through openings 257 and thus sheets the inner surface of the subsequent pipe 258 providing an air curtain in the downstream pipe to prevent it from being oveheated by air immediately leaving the blend box having a temperature greater than the desired downstream air temperature. This air 252 then mixes with the main body of the gases passing through the blend box to achieve the desired downstream temperature.

Figure 5:
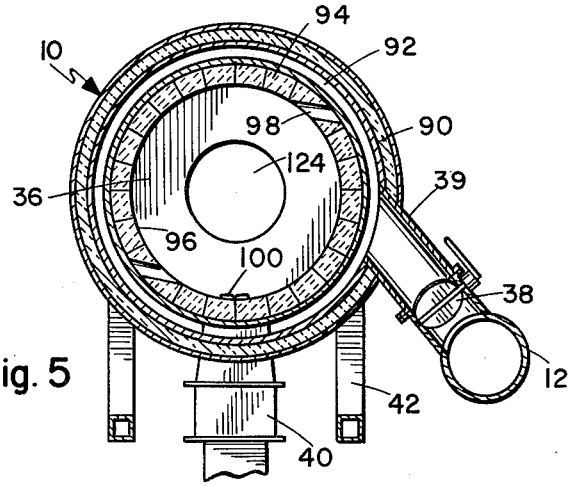
FIG. 5 is a sectional view taken on line 5—5 of FIG. 3.
Figure 6:
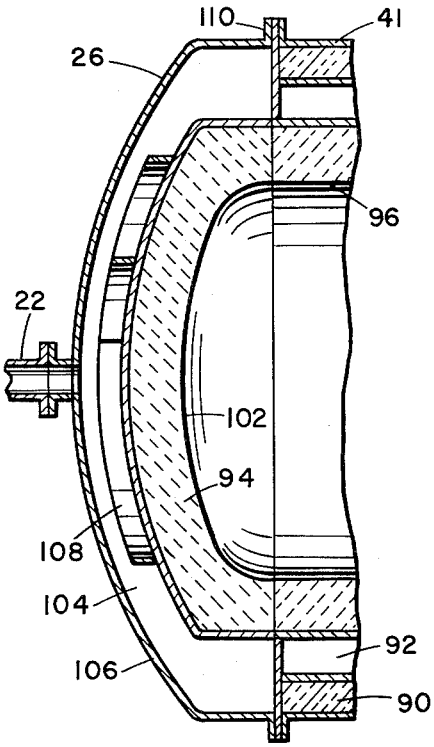
FIG. 6 is an enlarged sectional view taken on line 6—6 of FIG. 4.
Figure 7:
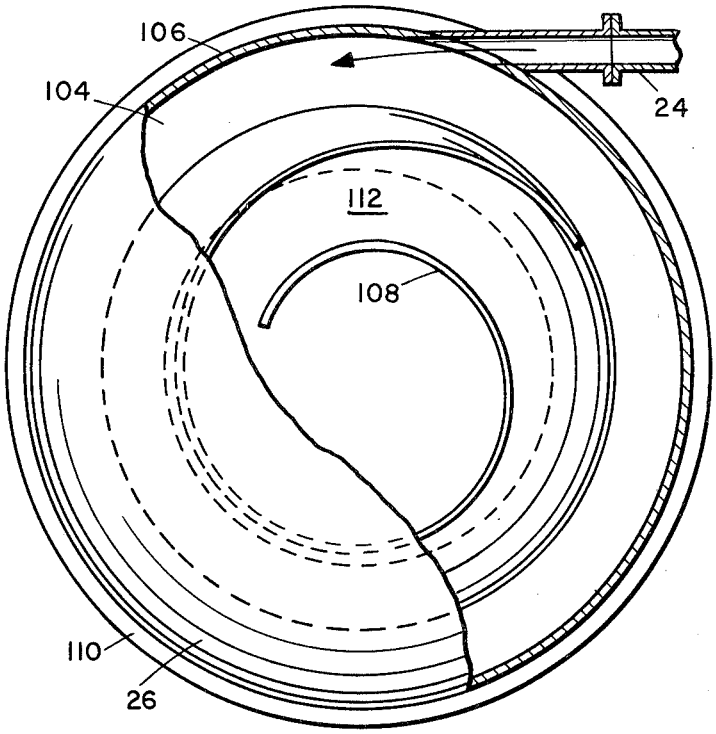
FIG. 7 is an end view partially cut away as taken from the left hand side of FIG. 6.

Thus the blend box 250 functions to control the temperature of the downstream air, aids in removing any possible carry-over slag, and also maintains the temperature of the downstream pipe immediately adjacent the burner and blend box. Each blend box air inlet is provided with a manually adjustable butterfly damper, similar to those in input pipes 35, 37 and 39, as illustrated in FIG. 5. These dampers adjust the air as necessary to achieve the desired downstream temperatures.

Having described our invention, we now claim:

1. A fuel/air ratio control system for controlling combustion within a burner independently of changes in the fuel mass flow rate caused by fluctuations in the density of fuel being supplied to said burner, said system comprising:

a. fuel mass flow rate detection means for detecting the mass flow rate of a fuel being supplied to said burner independently of fluctuations in the density of said fuel, said mass flow rate detection means including a mixing conduit having a first inlet means for permitting the introduction of a first fluid to said mixing conduit, outlet means for discharging fluid from said mixing conduit, and a second inlet means intermediate said first inlet means and said outlet means for permitting the introduction of said fuel into said mixing conduit, said mass flow rate detection means further including pressure difference detection means for detecting the pressures of fluid within said conduit at a first point between said first inlet means and said second inlet means and a second point between said second inlet means and said outlet means, respectively, and providing a signal responsive to the difference between said pressures;

b. air flow detection means for detecting the flow rate of air being supplied to said burner;

c. first comparison means for comparing said flow rate of air with said fuel mass flow rate and thereby providing an actual fuel/air mass ratio;

d. variable selection means for selecting a predetermined fuel/air mass ratio;

e. second comparison means for comparing said actual fuel/air mass ratio with said predetermined fuel/air mass ratio and providing an air flow rate change signal responsive to said second comparison; and f. control means for variable controlling said air flow rate automatically in responsive to said air flow rate change signal so as to provide said predetermined fuel/air mass ratio independently of changes in said fuel mass flow rate caused by fluctuations in said fuel density.

2. The fuel/air ratio control system of claim 1, further including fluid lock means for preventing said first fluid from flowing from said mixing conduit via said second inlet means.

3. The fuel/air ratio control system of claim 1, wherein said mixing conduit defines a passageway extending from said first inlet means to said outlet means, said passageway having a cross-sectional area which decreases from a first size at said first inlet means to a second smaller size at a location adjacent said second inlet means and thence increases to said first size at said outlet means.

4. A fuel/air ratio control process for controlling combustion within a burner independently of changes in the fuel mass flow rate caused by fluctuations in the density of fuel being supplied to said burner, said process comprising:

a. detecting the mass flow rate of a fuel being supplied to said burner independently of fluctuations in the density of said fuel, said detecting step including flowing a first fluid from an inlet of a mixing conduit to an outlet thereof, introducing said fuel into said mixing conduit via a second inlet intermediate said first inlet and said outlet, detecting the pressures of fluid within said mixing conduit at a first point between said first inlet and said second inlet and a second point between said second inlet and said outlet respectively and providing a signal responsive to the difference between said pressures;

b. detecting the flow rate of air being supplied to said burner;

c. comparing said flow rate of air with said fuel mass flow rate and thereby providing an actual fuel/air mass ratio;

d. selecting a predetermined fuel/air mass ratio;

e. comparing said actual fuel/air mass ratio with said predetermined fuel/air mass ratio and providing an air flow rate change signal responsive to said comparison; and f. variably controlling said air flow rate in response to said air flow rate change signal so as to provide said predetermined fuel/air mass ratio.

5. A fuel/air ratio control process for insuring combustion of all combustible portions of a fuel supplied to a burner, said process comprising:

a. detecting the total mass flow rate of fuel being supplied to said burner;

b. detecting the total flow rate of air being supplied to said burner;

c. comparing said total mass flow rate of fuel detected in step (a) with said total flow rate of air detected in step (b) and thereby providing an actual total fuel/air mass ratio;

d. selecting a predetermined complete combustion fuel/air mass ratio at which all combustible portions of the total fuel are burned;

e. comparing said actual total fuel/air mass ratio with said predetermined complete combustion fuel/air mass ratio and providing an air flow rate change signal responsive to said comparison;

f. variable controlling said total flow rate of air in response to said air flow rate change signal so as to provide said predetermined complete combustion fuel/air mass ratio; and g. directing said total flow rate of air into said burner and combustably combining said air with said total fuel to insure complete combustion of all combustible portions of said total fuel.

6. The process of claim 5 wherein said step (a) comprises detecting said total mass flow rate of fuel independently of fluctuations in the density of said fuel.

7. A fuel/air ratio control process for maintaining noncombustible portions of a fuel supplied to a burner in a slag form for collection within said burner, said process comprising:

a. selecting a predetermined range for the temperature of combustion gases within said burner where the noncombustible portions of the fuel supplied to said burner are maintained in a slag form;

b. detecting the temperature of said combustion gases;

c. comparing said combustion gas temperature with said predetermined range and variably controlling the mass flow rate of said fuel in response to said comparison so as to maintain said predetermined temperature range and thereby maintain said noncombustible portions of the fuel in a slag form;

d. detecting the mass flow rate of said fuel;

e. detecting the flow rate of air being supplied to said burner;

f. comparing said mass flow rate of fuel detected in step (d) with said flow rate of air detected in step (e) and thereby providing an actual fuel/air mass ratio;

g. selecting a predetermined fuel/air mass ratio;

h. comparing said actual fuel/air mass ratio with said predetermined fuel/air mass ratio and providing an air flow rate change signal in response thereto; and i. variably controlling said air flow rate in response to said air flow rate change signal so as to maintain said predetermined fuel/air mass ratio.

8. The process of claim 7, wherein step (d) comprises detecting said mass flow rate of fuel independently of fluctuations in the density of said fuel.

9. A fuel/air ratio control process for insuring the complete combustion of all combustible portions of a fuel supplied to a burner and for maintaining the temperature of combustion gases within said burner within a range where all noncombustible portions of said fuel are maintained in slag form for collection within said burner, said process comprising:

a. selecting a predetermined range for the temperature of combustion gases within said burner where the noncombustible portions of said fuel are maintained in slag form;

b. detecting the temperature of said combustion gases;

c. comparing said combustion gas temperature with said predetermined range and variably controlling the mass flow rate of fuel in response to said comparison so as to maintain said predetermined temperature range and thereby maintain said noncombustible portions of the fuel in slag form;

d. detecting the total mass flow rate of fuel being supplied to said burner;

e. detecting the total flow rate of air being supplied to said burner;

f. comparing said total mass flow rate of fuel detected om step (d) with said total flow rate of air detected in step (e) and thereby providing an actual total fuel/air mass ratio;

g. selecting a predetermined complete combustion fuel/air mass ratio at which all combustible portions of said total fuel are burned;

h. comparing said actual total fuel/air mass ratio with said predetermined complete combustion fuel/air mass ratio and providing an air flow rate change signal responsive to said comparison;

i. variably controlling said total flow rate of air in response to said air flow rate change signal so as to provide said predetermined complete combustion fuel/air mass ratio; and j. directing said total flow rate of air into said burner and combustably combining said air with said total fuel to insure complete combustion of all combustible portions of said total fuel.

10. The process of claim 9, wherein step (d) comprises detecting said mass flow rate of fuel independently of fluctuations in the density of said fuel.

* * * * *